US008068771B2

(12) United States Patent
Yoshimoto

(10) Patent No.: US 8,068,771 B2
(45) Date of Patent: Nov. 29, 2011

(54) IMAGE FORMING APPARATUS

(75) Inventor: Yuhsuke Yoshimoto, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 498 days.

(21) Appl. No.: 12/331,767

(22) Filed: Dec. 10, 2008

(65) Prior Publication Data

US 2009/0162108 A1 Jun. 25, 2009

(30) Foreign Application Priority Data

Dec. 21, 2007 (JP) ..... 2007-330450

(51) Int. Cl.
*G03G 15/09* (2006.01)

(52) U.S. Cl. ..... 399/267; 399/277

(58) Field of Classification Search ..... 399/267, 399/277

See application file for complete search history.

(56) References Cited

U.S. PATENT DOCUMENTS

| | | | |
|---|---|---|---|
| 5,488,465 | A | 1/1996 | Yamamoto et al. |
| 5,543,901 | A | 8/1996 | Yamamoto et al. |
| 7,470,498 | B2 | 12/2008 | Iimuma et al. |

FOREIGN PATENT DOCUMENTS

| | | | | |
|---|---|---|---|---|
| JP | 63-052167 | A | | 3/1988 |
| JP | 2-19877 | A | | 1/1990 |
| JP | 04095969 | A | * | 3/1992 |
| JP | 6-043759 | A | | 2/1994 |
| JP | 07261540 | A | * | 10/1995 |
| JP | 10-232559 | A | | 9/1998 |
| JP | 11-161023 | A | | 6/1999 |
| JP | 1768307 | A | | 5/2006 |
| JP | 2007-108538 | A | | 4/2007 |

* cited by examiner

*Primary Examiner* — David Gray
*Assistant Examiner* — Erika J Villaluna
(74) *Attorney, Agent, or Firm* — Nixon & Vanderhye P.C.

(57) ABSTRACT

A developing unit includes a developing hopper for storing a dual-component developer. In the developing hopper, an opening portion is formed at the position opposing the outer peripheral surface of a photoreceptor drum. A developing roller for supplying the developer to the photoreceptor drum to develop an electrostatic latent image is provided inside the developing hopper. The developing roller has a multi-pole magnetic member having a multiple magnetic poles and a non-magnetic sleeve. The multi-pole magnetic member has a multiple number of magnetic poles radially arranged apart from each other. The photoreceptor drum incorporates an opposing magnetic pole formed of a bar magnet having a rectangular section, disposed at a position opposing the magnetic pole across a photosensitive layer. The opposing magnetic pole has a polarity dissimilar to that of the main magnetic pole.

9 Claims, 6 Drawing Sheets

IMAGE FORMING APPARATUS

This Nonprovisional application claims priority under 35 U.S.C. §119 (a) on Patent Application No. 2007-330450 filed in Japan on 21 Dec. 2007, the entire contents of which are hereby incorporated by reference.

BACKGROUND OF THE TECHNOLOGY (1) Field of the Technology

The present technology relates to an image forming apparatus based on electrophotography using a dual-component developing system.

(2) Description of the Prior Art

In image forming apparatus based on electrophotography, which are often applied to copiers, printers, facsimile machines, etc., a photoreceptor drum having a photosensitive layer containing photoconductive substances formed on the surface thereof is used as an image bearer, the surface of the photoreceptor drum is uniformly electrified by imparting electric charge, then an electrostatic latent image corresponding to image information is formed using various image forming processes. This electrostatic latent image is developed by supplying a developer containing a toner from a developing roller or the like to form a toner image, which in turn is directly transferred to a recording medium such as paper etc. Alternatively, the toner image may be once transferred to an intermediate transfer element (which will be referred to hereinbelow as "primary transfer"), then the image is transferred from intermediate transfer element to a recording medium (which will be referred to hereinbelow as "secondary transfer"). The toner image thus secondarily transferred is usually fixed to the recording medium by a fusing means.

FIG. 1 is a schematic view showing a configuration of a photoreceptor drum 51, a developing unit 54 and therearound. A developing roller 57 supported by a developing hopper 56 of developing unit 54 is arranged a clearance away from photoreceptor drum 51. Developing unit 57 includes a multi-pole magnetic member 65 having multiple magnetic poles and a non-magnetic sleeve 66 which is rotatably fitted on multi-pole magnetic member 65. Multi-pole magnetic member 65 is a so-called magnet roller having a plurality of magnetic poles 71 to 75 radially arranged apart from each other. A dual-component developer 64 containing toner and carrier is supported on the developing roller 57 surface and conveyed by the magnetic force generated by these magnetic poles 71 to 75. Main magnetic pole 71 arranged at the proximal position between developing roller 57 and photoreceptor drum 51 form a magnetic brush of dual-component developer 64 by its magnetic force so as to form a developing nip area in which dual-component developer 64 is in contact with photoreceptor drum 51.

In the nip area, the toner is attracted to the electrostatic latent image on the photoreceptor drum 51 surface and transfers to the photoreceptor drum 51 surface to develop the electrostatic latent image. The carrier passing by the developing nip area will not adhere to photoreceptor drum 51 surface but returns into developing hopper 56.

A regulating member 58 is disposed at a position near the opening mouth of developing hopper 56 and on the upstream side with respect to the conveyed direction of the developer by developing roller 57, and an agitating member 59 is provided inside developing hopper 56.

FIG. 2 is a schematic diagram showing lines of magnetic force around conventional photoreceptor drum 51, developing roller 57 and therearound. The lines of magnetic force are formed from main magnetic pole 71 toward adjacent magnetic poles 72 and 73 of the opposite polarity. The magnetic flux density becomes maximum at the center of the developing nip area (which will be referred to hereinbelow as "developing nip center"). The magnetic flux density becomes lower than in the developing nip center, in both ends of the developing nip area (hereinbelow, the end on the upstream side of the developing roller's direction of rotation will be called "developing nip front end" and the end on the downstream side of the developing roller's direction of rotation will be called "developing nip rear end").

In the first prior art, the magnet roller has a single main pole magnet having a dissimilar magnetic pole at each end on the outer and inner sides. Also, the photoreceptor drum includes a magnet therein, which is arranged so that its magnetic pole on the magnet roller side has a polarity opposite the magnetic pole on the outer side of the magnet roller. With this arrangement, it is possible to easily form a magnetic brush by a developing roller having only a single main pole magnet therein (see Japanese Patent Application Laid-open Sho 63-52167).

In the second prior art, in the developing unit, a magnetic element is arranged at a position inside the photoreceptor drum opposing the main pole magnet of the developing roller. With this arrangement, it is possible to widen the developing nip area by increasing the magnetic flux density (see Japanese Patent Application Laid-open Hei 04-287061). When the magnetic force of the main pole magnet is too strong, the rubbing force of the magnetic brush formed of the dual-component developer becomes too strong, so that the toner on the photoreceptor drum surface is disturbed by the strong rubbing force, causing image degradation of the resultant image.

Conversely, when the magnetic force of the main pole magnet is too weak, the carrier that is attracted to the photoreceptor drum by electrostatic force in the developing nip rear end the will not return to the developing roller surface but remains developed on the photoreceptor drum surface, hence transfer failure of the toner image occurs in the transfer stage, producing white voids in the resultant image.

In the recent image forming apparatus using fine particulate carrier, in order to form images of high quality, the magnetic force of the main pole magnet toward the developing nip area is weakened or the saturation magnetization of the carrier is lowered. However, when the magnetic brush is made soft so as to avoid disturbance of the toner image developed on the photoreceptor drum from the electrostatic latent image, such measures weaken the developing roller's force for collecting the carrier at the most downstream side of the developing nip with respect to the developer roller's direction of rotation, hence giving rise to the problem that the carrier is developed on the photoreceptor drum surface, causing image defects such as white voids etc. due to transfer failure.

SUMMARY OF THE TECHNOLOGY

It is therefore an object of the present technology to solve the above conventional problems and provide an image forming apparatus which can produce high quality images free from white voids without causing carrier development onto the photoreceptor drum.

The image forming apparatus for solving the above problems, comprises: a photoreceptor drum including a photosensitive layer; and a developing roller for supplying a dual-component developer to the photoreceptor drum, and is characterized in that the developing roller includes a main magnetic pole for forming a magnetic brush that rubs and supplies the dual-component developer over the photoreceptor drum; the photoreceptor drum includes an opposing magnetic pole having a polarity that is dissimilar from that of the main magnetic pole, located at a position opposing the main magnetic pole across the photosensitive layer; and the main magnetic pole is disposed away to the downstream side with respect to the rotational direction of the developing roller from the closest position where the distance between the developing roller and the photoreceptor drum is shortest while the opposing magnetic pole is disposed away to the upstream side with respect to the rotational direction of the developing roller from the closest position of the developing roller and the photoreceptor drum.

The configuration can widen the nip width by formation of the lines of magnetic force from the main magnetic pole toward the opposing magnetic pole, and also can form a soft magnetic brush around the closest position of the developing roller and the photoreceptor drum. It is also possible to enhance the force for attracting the carrier from the photoreceptor drum, on the downstream side of the developing nip with respect to the rotational direction of the developing roller. As a result, it is possible to produce images that are high in image density, excellent in dot reproduction performance and free from white voids.

The image forming apparatus for solving the above problems is characterized in that the magnetic flux density of the magnetic field formed by the main magnetic pole on the center surface of the main magnetic pole falls within the range of 100 mT to 140 mT.

The setting as above enables suppression of carrier development without disturbing the toner image on the photoreceptor drum.

The image forming apparatus for solving the above problems is characterized in that the magnetic flux density of the magnetic field formed by the opposing magnetic pole on the center surface of the opposing magnetic pole falls within the range of 15% to 35% of the magnetic flux density of the magnetic field formed by the main magnetic pole on the center surface of the main magnetic pole.

The setting as above makes it possible to widen the developing nip width while keeping suitable rubbing force of the magnetic brush, hence it is possible to produce images of high image density.

The image forming apparatus for solving the above problems is characterized in that the angle formed between the straight line joined between the center of the main magnetic pole and the rotary axis of the developing roller and the straight line joined between the rotary axis of the developing roller and the rotary axis of the photoreceptor drum falls within the range of 3 degrees to 10 degrees.

The setting as above makes it possible to enhance the magnetic flux density around the developing nip on the downstream side with respect to the rotational direction of the developing roller, it is hence possible to suppress carrier development without increasing the magnetic force of the main magnetic pole.

The image forming apparatus for solving the above problems is characterized in that the angle formed between the straight line joined between the center of the opposing magnetic pole and the rotary axis of the photoreceptor drum and the straight line joined between the rotary axis of the developing roller and the rotary axis of the photoreceptor drum falls within the range of 2 degrees to 10 degrees.

The setting as above makes it possible to widen the developing nip width while keeping suitable rubbing force of the magnetic brush, hence it is possible to produce images of high image density.

The image forming apparatus for solving the above problems is characterized in that the dual-component developer includes a carrier having a saturation magnetization falling within the range of 30 emu/g to 70 emu/g.

The setting as above makes it possible to form a magnetic brush of a dual-component developer having a suitable hardness, it is hence possible to realize improved dot reproducibility and suppress carrier development.

The image forming apparatus for solving the above problems is characterized in that the volume mean diameter of the carrier falls within the range of 20 μm to 60 μm.

The setting as above makes it possible to enhance the performance of imparting charge to fine particulate toner, prevent fogging and toner scattering, realize improved dot reproducibility, suppress carrier transfer to the photoreceptor drum, and hence produce images of high quality free from white voids. Further, since appropriate rubbing force can be imparted to the magnetic brush, it is possible to suppress disturbance of toner images hence produce high-quality images.

The image forming apparatus for solving the above problems is characterized in that the surface of the carrier is coated with silicone resin.

Since silicone resin is excellent in anti-pollution performance and abrasion resistance, use of silicone makes the carrier surface unlikely to be polluted hence contributes to producing images free from fogging and coarseness when it is used over a prolonged period of time.

The configuration can widen the nip width by formation of the lines of magnetic force from the main magnetic pole toward the opposing magnetic pole, and also can form a soft magnetic brush around the closest position of the developing roller and the photoreceptor drum. It is also possible to enhance the force for attracting the carrier from the photoreceptor drum, on the downstream side of the developing nip with respect to the rotational direction of the developing roller. As a result, it is possible to produce images that are high in image density, excellent in dot reproduction performance and free from white voids.

DESCRIPTION OF THE PREFERRED EMBODIMENTS

One embodiment of an image forming apparatus will be described with reference to the drawings.

Figure 3:
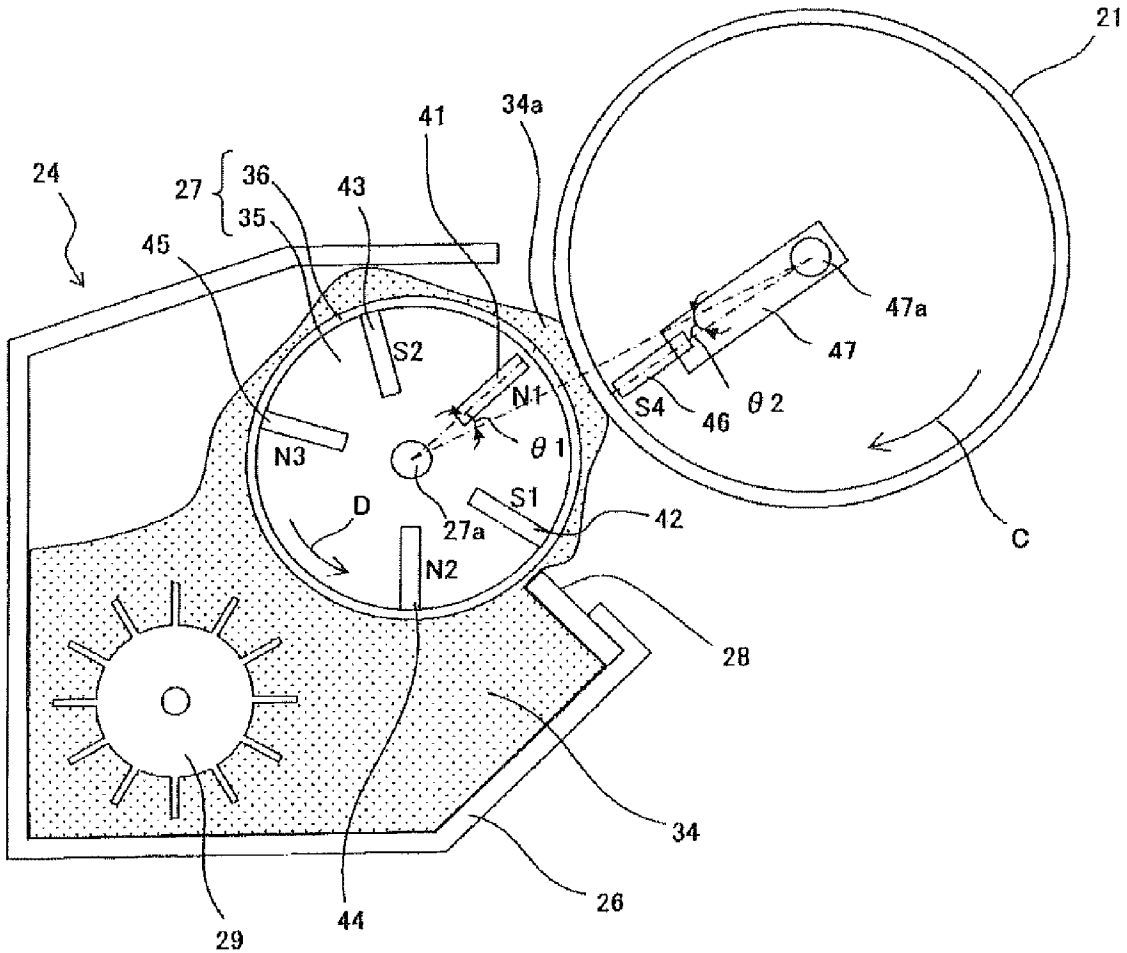
FIG. 3 is an enlarged essential view showing the surroundings of a device developing roller and a photoreceptor drum in an image forming apparatus.
Figure 4:
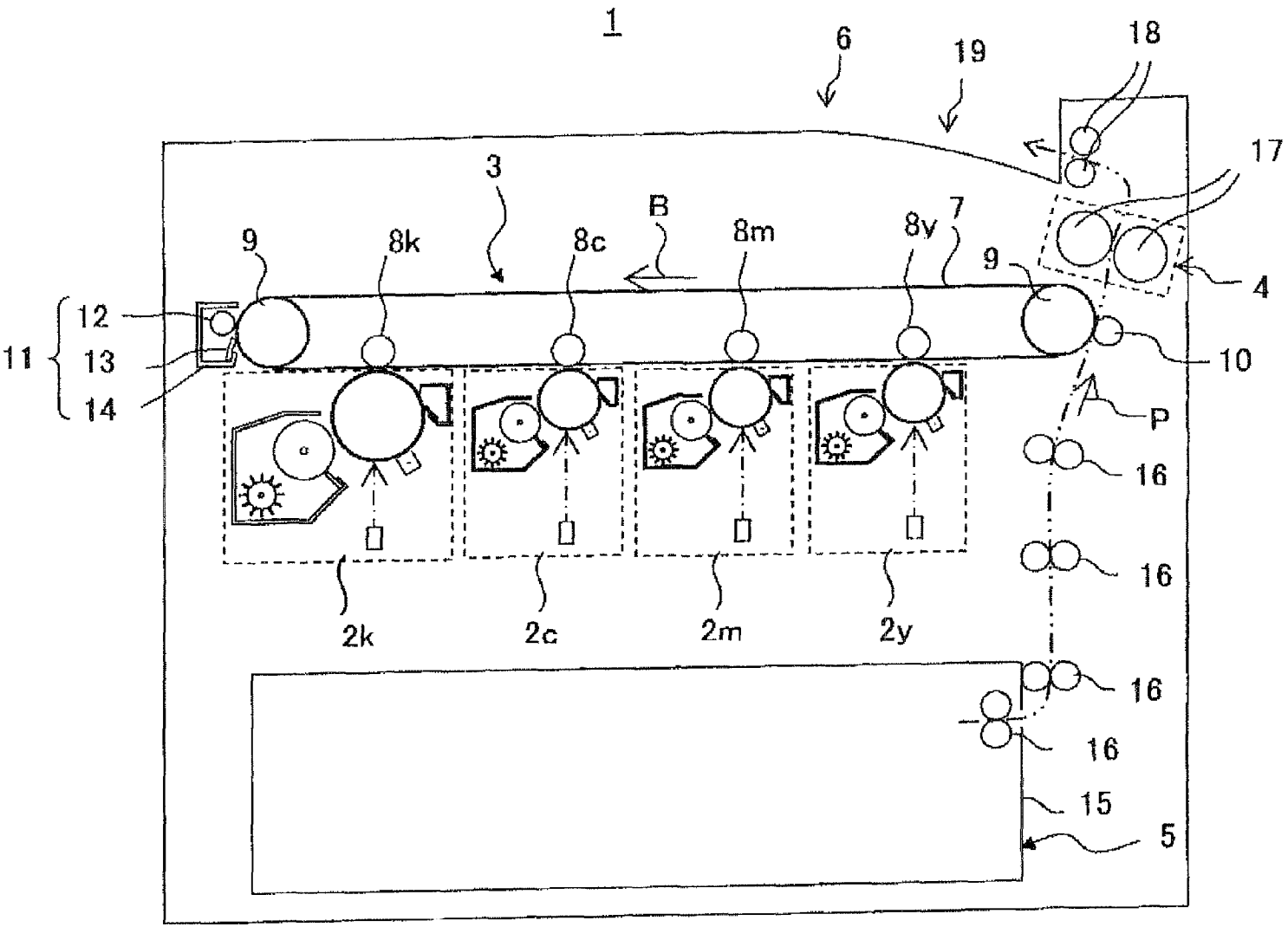
FIG. 4 is a view showing an overall configuration of an image forming apparatus.
Figure 5:
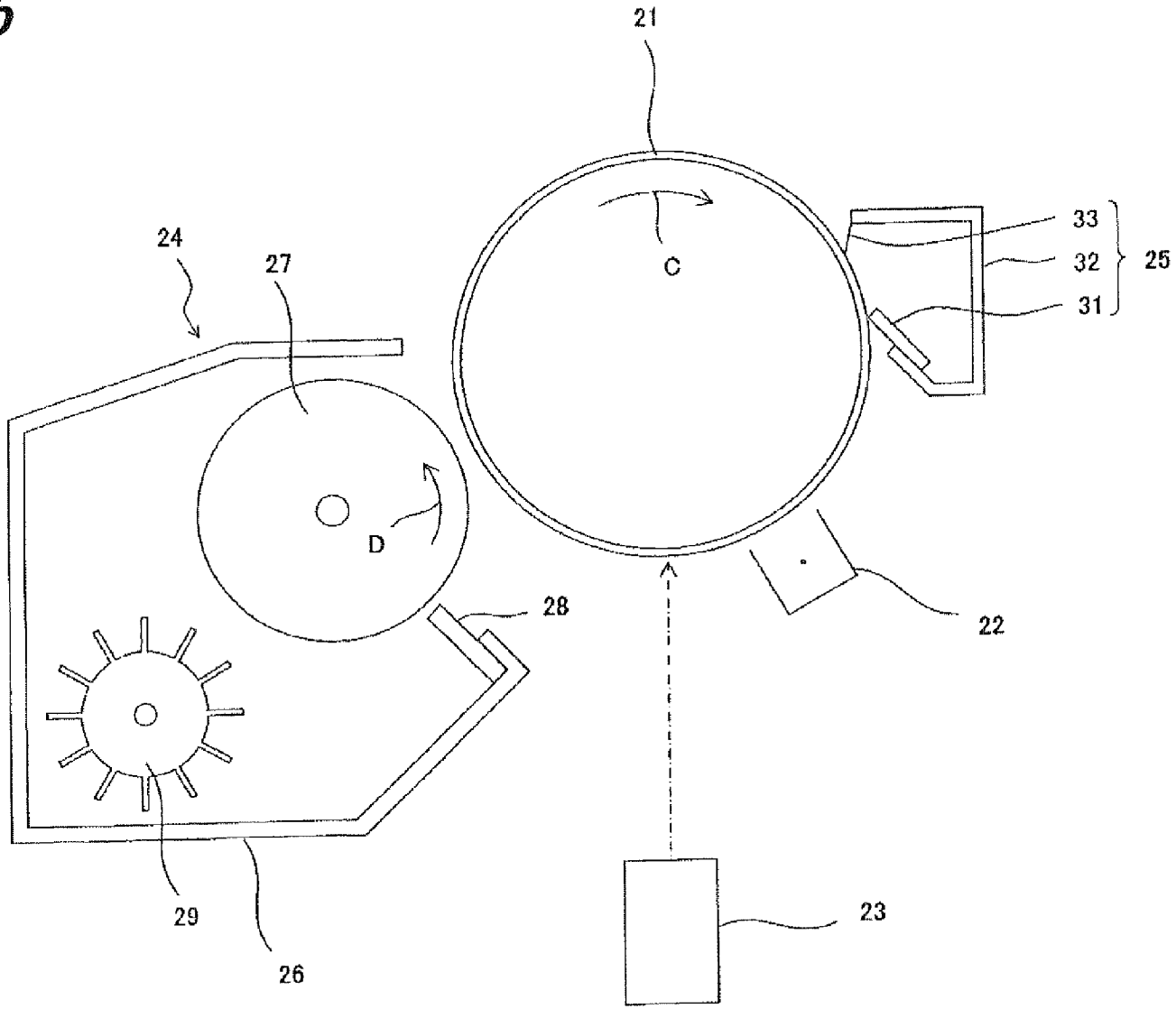
FIG. 5 is an enlarged view showing an image forming device in FIG. 4; and, FIG. 6 is a schematic view showing how lines of magnetic force are formed around the developing nip.

FIG. 3 is an enlarged essential view showing the surroundings of a device developing roller and a photoreceptor drum in an image forming apparatus; FIG. 4 shows an overall configuration of an image forming apparatus; and FIG. 5 is an enlarged view of an image forming device in FIG. 4.

In FIG. 4 showing the overall configuration of an image forming apparatus, an image forming apparatus 1 forms a full-color or monochrome image on a recording medium in accordance with transferred image information. Image forming apparatus 1 includes four toner image forming devices 2, a transfer device 3, a fusing device 4, a recording medium supplying device 5 and a discharge device 6. In order to deal with image information of each of the colors, black (k), cyan (c), magenta (m) and yellow (y), each of the components that constitute toner image forming device 2 is given in four, and also some of the components included in transfer device 3 are given in four. Here, the components provided in four for each color are differentiated by adding the alphabet that represents each color at the end of the reference numerals. When general mention is made, only the reference numerals with no alphabet are used. Image forming apparatus 1 is a color image forming apparatus of a tandem system including four toner image forming devices 2.

Arranged vertically above toner image forming devices 2 is transfer device 3. Each mono-color toner image formed on toner image forming device 2 is transferred to a recording medium by transfer device 3. Toner image forming devices 2 will be detailed later. Transfer device 3 includes an intermediate transfer belt 7, primary transfer rollers 8, supporting rolls 9*a* and 9*b*, a secondary transfer roller 10 and a belt cleaning unit 11.

Intermediate transfer belt 7 is arranged at a position opposing toner image forming devices 2. Intermediate transfer belt 7 is an endless belt. As the material for intermediate transfer belt 7, resin such as polyimide, polyamide or the like containing an appropriate amount of electron conductive material may be used. Intermediate transfer belt 7 is wound between a pair of supporting rolls 9*a* and 9*b* and circulatively driven in the direction of arrow B by a driving means (not shown).

Four toner image forming devices 2*k*, 2*c*, 2*m* and 2*y* are arranged in this order from the upstream side with respect to the rotational direction B of intermediate transfer belt 7.

Arranged on the interior side of intermediate transfer belt 7 are primary transfer rollers 8, which are positioned so as to oppose toner image forming devices 2 across intermediate transfer belt 7. Primary transfer rollers 8 transfer mono-color images formed on toner image forming devices 2 onto intermediate transfer belt 7. The mono-color toner images formed on different toner image forming devices 2 are transferred onto intermediate transfer belt 7, one over the other, forming one full color image.

Arranged on the downstream side of toner image forming devices 2 with respect to the rotational direction B of intermediate transfer belt 7 is secondary transfer roller 10 for transferring the color image formed on intermediate transfer belt 7 to paper (recording medium). Secondary transfer roller 10 is disposed at a position opposing supporting roll 9*a* across intermediate transfer belt 7.

Further, a belt cleaning unit 11 for clearing the surface of intermediate transfer belt 7 is arranged on the downstream side of secondary transfer roller 10 with respect to the rotational direction B of intermediate transfer belt 7. Belt cleaning unit 11 opposes supporting roll 9*b* across intermediate transfer belt 7 so as to be in contact with the outer peripheral surface of intermediate transfer belt 7. Since toner adhering on intermediate transfer belt 7 after secondary transfer will be the cause of dirtying the rear side of the recording medium, belt cleaning unit 11 removes and collects the toner from the intermediate transfer belt 7 surface.

Belt cleaning unit 11 includes a belt cleaning brush 12 that is arranged in contact with intermediate transfer belt 7, a belt cleaning blade 13 and a belt cleaner housing 14. Belt cleaning blade 13 is arranged downstream of belt cleaning brush 12 with respect to the rotational direction B of intermediate transfer belt 7.

On the other hand, recording medium supplying device 5 feeds a recording medium to the secondary transfer position of secondary transfer roller 10. A tray 15 for stacking recording mediums is arranged vertically under toner image forming devices 2. The recording mediums in tray 15 are conveyed, sheet by sheet, by a plurality of paper feed rollers 16 to the secondary transfer position where secondary transfer roller 10 opposes intermediate transfer belt 7. An arrow P designates the recording medium's direction of movement.

Arranged on the downstream side of secondary transfer roller 10 with respect to the moving direction P of the recording medium, is fusing device 4 for fixing the transferred color image on the recording medium or paper to the paper. Fusing device 4 fixes the image to the recording medium by heating and pressing the toner image as the recording medium passes through the fusing nip portion between a pair of fusing rollers 17. Then, the recording medium is further conveyed toward discharging device 6 located downstream of fusing roller 17 with respect to the moving direction P of the recording medium. Herein, the recording medium with a color image fixed thereon is made to pass through the discharge nip portion between a pair of paper discharge rollers 18 for discharging recording mediums from image forming apparatus 1, being discharged to a paper output tray 19.

In the above arrangement, the mono-color toner images formed by each of toner image forming devices 2 are sequentially transferred to intermediate transfer belt 7, whereby a color toner image is formed on intermediate transfer belt 7. The color image on intermediate transfer belt 7 is secondarily transferred to the paper that is being conveyed by paper feed rollers 16 to the secondary transfer station, then is fixed to the paper by fusing device 4. The paper with the color image fixed thereon is discharged from image forming apparatus 1 by paper discharge rollers 18. On the other hand, after secondary transfer, the toner that has not been transferred to the paper but remains on intermediate transfer belt 7 is removed by belt cleaning unit 11.

In FIG. 5 that shows an enlarged view of the image forming device, a cylindrical photoreceptor drum 21 is provided so as to be rotatable in the direction of arrow C. Around photoreceptor drum 21, a charger 22 for electrifying photoreceptor drum 21, an exposure unit 23 for writing an electrostatic latent image on photoreceptor drum 21, a developing unit 24 for visualizing the electrostatic latent image on photoreceptor drum 21 to form a toner image, a photoreceptor drum cleaner 25 for removing residues including leftover toner on photoreceptor drum 21 after primary transfer of the toner image to the aforementioned intermediate transfer belt 7, are arranged in this order in the rotational direction C.

Examples of photoreceptor drum 21 include cylindrical organic and amorphous silicon photoreceptor drums formed of a conductive substrate and a photosensitive layer, etc. From the viewpoint of manufacturing cost and from a safety viewpoint, organic photoreceptor drums are suitable. Organic photoreceptor drums are classified into two types, the lamination type and the mono-layered type. The lamination-type photoreceptor drum is preferred in view of being excellent in sensitivity, residual potential and others. The lamination-type photoreceptor drum is typically formed of a charge generation layer containing charge generating substances and a charge transport layer containing charge transport substances, laminated on a conductive substrate. However, it is further preferable if an undercoat layer is interposed between the conductive substrate and the charge generation layer.

Examples of the conductive substrate include cylindrical aluminum and plastics including conductive particles and others. As the examples of the undercoat layer, polyamide resin and copolymerized nylon resin containing inorganic pigments such as zinc oxide and titanium oxide, dispersed by a disperser such as a ball mill, Dyno mill or the like, can be used.

As the examples of the charge generation layer, polycarbonate resin, phenoxy resin, phenol resin, polyvinyl butyral resin, polyacrylate resin, polyamide resin, polyester resin and the like in which a charge generating substance that generates charge by irradiation of light, e.g., an organic pigment such as non-metallic phthalocyanine pigment, titanyl phthalocyanine pigment or the like is dispersed by a disperser such as a ball mill, Dyno mill or the like, can be used.

The charge transport layer is provided over the charge generation layer, and may use polycarbonate, copolymerized polycarbonate, polyacrylate and the like, in which a charge transport substance that has the capability of accepting charges generated by the charge generation substance and transporting them, specifically, an electron donative substance or an electron acceptive substance, is contained.

Examples of the electron donative substance include poly-N-vinyl carbazole and its derivatives, poly-γ-carbazolyl ethylglutamate and its derivatives, pyrene-formaldehyde condensate and its derivatives, polyvinyl pyrene, polyvinyl phenanthrene, oxazole derivatives, oxadiazole derivatives, imidazole derivatives, 9-(p-diethylaminestyryl) anthracene, 1,1-bis(4-dibenzyl aminophenyl) propane, styryl anthracene, styrylpyrazoline, pyrazoline derivatives, phenylhydrazones, hydrazone derivatives, triphenylamine compounds, triphenylmethane compounds, stilbene compounds, azine compounds having a 3-methyl-2-benzothiazoline ring, etc.

Examples of electron acceptive substances include fluorenone derivatives, dibenzothiophene derivatives, indeno thiophene derivatives, phenanthrene quinone derivatives, indeno pyridine derivatives, thioxanthone derivatives, benzo [c]cinnoline derivatives, phenazine oxide derivatives, tetracyanoethylene, tetracyanoquinodimethane, bromanil, chloranil, benzoquinone, etc. The charge transport substance is preferably contained in an amount of 30 to 80% by weight in the charge transport layer.

Charger 22 may be, for example a scorotron charger, which electrifies photoreceptor drum 21 at a predetermined potential by corona discharge over photoreceptor drum 21. Alternatively, the charger may be formed of a scorotron charger or a contact-type charger using a charging roller or charging brush.

Exposure unit 23 may be, for example a laser exposure unit, which performs laser scanning in accordance with an image signal so as to change the surface potential of photoreceptor drum 21 that has been electrified by charger 22, whereby an electrostatic latent image corresponding to the image information is formed. As exposure unit 23, an LED (light emitting diode) array device or the like may also be used.

Developing unit 24 includes a developing hopper 26 for storing the developer. In developing hopper 26, an opening mouth is formed at the position opposing the outer peripheral surface of photoreceptor drum 21.

Inside developing hopper 26, a developing roller 27 that carries the developer on the outer peripheral surface thereof and conveys and supplies the developer to photoreceptor drum 21 to develop the electrostatic latent image into a toner image is provided at a position opposing the opening mouth. Developing roller 27 is arranged a clearance away from the outer peripheral surface of photoreceptor drum 21.

A regulating member 28 for limiting the thickness of the developer layer carried on the outer peripheral surface of developing roller 27 so as to control the amount of the developer to be conveyed to the electrostatic latent image, is disposed at a position near the opening mouth of developing hopper 26 and on the upstream side with respect to the conveyed direction of the developer by developing roller 27. This regulating member 28 is arranged a predetermined distance away from the outer peripheral surface of developing roller 27.

Further, an agitating member 29 for agitating the developer in developing hopper 26 and supplying the developer to developing roller 27 is rotatably arranged inside developing hopper 26 at a position opposing developing roller 27.

Types of the developer include the dual-component type that contains toner and carrier and the mono-component type that contains toner alone with no carrier. Image forming apparatus 1 uses a dual-component developer and has a configuration supporting the dual-component developer.

The toner preferably includes a binder resin, a coloring agent, a charge control agent, a releasing agent, a fluidizer and the like.

As the binder resin, various publicly known styrene-acrylic resins, polyester resins and others can be used. In particular, linear or non-linear polyester resin is preferred. Polyester resin is excellent in providing mechanical strength (hard to be broken into powder), fixability (hard to separate from paper after fusing) and resistance to hot offset at the same time.

Polyester resin can be obtained by polymerizing dihydric or higher polyhydric alcohols and polybasic acids, and monomer composition consisting of trihydric or higher polyhydric alcohols or tribasic or higher polybasic acids, as required. Examples of the dihydric alcohol used for polymerization of polyester resin include: diols such as ethylene glycol, diethylene glycol, triethylene glycol, 1,2-propylene glycol, 1,3-propylene glycol, 1,4-butane diol, neopentyl glycol, 1,4-butane diol, 1,5-pentane diol and 1,6-hexane diol; alkylene oxide adducts of bisphenol A such as bisphenol A, hydrogenated bisphenol A, polyoxyethylene bisphenol A, polyoxy propylene bisphenol A and the like; and others.

Example of trihydric or higher polyhydric alcohols include: sorbitol, 1,2,3,6-hexane tetrol, 1,4-solbitane, pentaerythritol, dipentaerythritol, tripentaerythritol, sucrose, 1,2,4-butanetriol, 1,2,5-pentanetriol, glycerol, 2-methyl propanetriol, 2-methyl-1,2,4-butanetriol, trimethylol ethane, trimethylol propane, 1,3,5-trihydroxy methyl benzene and the like.

Examples of dibasic acids include: maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid and anhydrides and low alkyl esters of these acids, alkenyl succinic acids and alkyl succinic acids such as n-dodecenyl succinic acid, n-dodecyl succinic acid, etc.

Example of tribasic or higher polybasic acids include: 1,2,4-benzenetricarboxylic acid, 1,2,5-benzene-tricarboxylic acid, 1,2,4-cyclohexanetricarboxylic acid, 2,5,7-naphthalenetricarboxylic acid, 1,2,4-naphthalene-tricarboxylic acid, 1,2,5-hexanetricarboxylic acid, 1,3-dicarboxyl-2-methyl-2-methylene-carboxypropane, tetra (methylene carboxyl) methane, 1,2,7,8-octane tetracarboxyl acid, and anhydrides of these and the like.

As the coloring agents, publicly known pigments, colorants and the like that are usually used for toner can be used. As the specific examples, carbon black, magnetite and the like can be mentioned for black toner.

Examples of the coloring agent for yellow toner include: acetoacetic arylamide monoazo yellow pigments such as C.I. pigments yellow 1, 3, 74, 97, 98 and the like; acetoacetic arylamide disazo yellow pigments such as C.I. pigments yellow 12, 13, 14, 17 and the like; condensed monoazo yellow pigments such as C.I. pigments yellow 93, 155 and the like; other yellow pigments such as C.I. pigments yellow 180, 150, 185 and the like; and yellow dyes such as C.I. solvents yellow 19, 77, 79, C.I. disperse yellow 164, and the like.

Examples of the coloring agent for magenta toner include: C.I. pigments red 48, 49:1, 53:1, 57, 57:1, 81, 122, 5, 146, 184, 238; red or crimson pigments such as C.I. pigment violet 19 and the like; red dyes such as C.I. solvents red 49, 52, 58, 8 and the like.

Examples of the coloring agent for cyan toner include: blue dyes and pigments such copper phthalocyanine and its derivatives such as C.I. pigments blue 15:3, 15:4 and the like; and green pigments such as C.I. pigments green 7, 36 (phthalocyanine green) and the like.

The added amount of coloring agent is preferably 1 to 15 parts by weight or more preferably 2 to 10 parts by weight to 100 parts by weight of the binder resin.

As the charge control agents, publicly known charge control agents can used. Specifically, examples of the charge control agent for providing negative charge, include chromium azo complex dye, iron azo complex dye, cobalt azo complex dye, chromium, zinc, aluminum and boron complexes or salts of salicylic acid or its derivatives, chromium, zinc, aluminum and boron complexes or salts of naphtol acid or its derivatives, chromium, zinc, aluminum and boron complexes or salts of benzyl acid or its derivatives, long-chain alkyl carboxylates, long-chain alkyl sulfonates and the like.

Examples of the charge control agent for providing positive charge include nigrosine dye and its derivatives, triphenyl methane derivatives, derivatives of quaternary ammonium salts, quaternary sulfonium slats, quaternary pyridinium salts, guanidine salts, amidine salts and the like.

The added amount of these charge control agents is preferably 0.1 to 20 parts by weight or more preferably 0.5 to 10 parts by weight to 100 parts by weight of the binder resin.

As the releasing agent, petroleum wax including: synthesized wax such as polypropylene and polyethylene; paraffin wax and its derivatives; and microcrystalline wax and its derivatives, and its modified wax, and plant-derived wax including carnauba wax, rice wax and candelilla wax can be listed. Containing these releasing agents in the toner makes it possible to improve the separation performance of the toner from the fusing roller or fusing belt, hence prevent high-temperature and low-temperature offset during fusing.

It is possible to add a publicly known fluidizer in order to improve the toner in fluidity. Examples of the applicable fluidizers include inorganic micro particles imparted with hydrophobicity by treating the surface of inorganic micro particles of silica, titanium oxide, alumina and the like, having a mean particle size of 0.007 to 0.03 μm, with a silane coupling agent, titanium coupling agent or silicone oil.

Since no improvement in fluidity is observed when the added amount of the fluidizer is 0.3 part by weight or below, whereas degradation of the fusing performance becomes prone to occur when the added amount is 3 parts by weight or greater, the fluidizer is preferably added in an amount of 0.3 to 3 parts by weight.

The volume mean diameter of the carrier preferably falls within the range of 20 μm to 60 μm. This specification prevents carrier development to photoreceptor drum 21, hence making it possible to produce high-quality images free from white voids. Further, this also imparts appropriate rubbing force to the magnetic brush, hence it is possible to produce high-quality images while suppressing disturbance of toner images.

When it is less than 20 μm, carrier development to photoreceptor drum 21 is prone to occur. When it exceeds 60 μm, high-quality images cannot be obtained.

The saturation magnetization of the carrier preferably falls within the range of 30 emu/g to 70 emu/g. Use of such a carrier thus specified can suitably rigidify the magnetic brush formed of dual-component developer 34, or allows formation of a magnetic brush having suitable rigidity, hence the frictional force of the abrasive, which is externally added to the toner, to rub the photoreceptor drum 21 surface becomes greater, producing a greater effect of scraping talc that adheres to the photoreceptor drum 21 surface. Accordingly, it is possible to prevent carrier development to photoreceptor drum 21 and hence produce high-quality images free from white voids.

When the saturation magnetization exceeds 70 emu/g, the magnetic brush becomes too rigid to obtain images faithful to electrostatic latent images. In addition, white voids become prone to occur in the resultant image. In contrast, since the lower the saturation magnetization of the carrier, the softer the magnetic brush in contact with photoreceptor drum 21 becomes, it is possible to obtain images faithful to electrostatic latent images. However, if the saturation magnetization is less than 30 emu/g, the carrier tends to adhere to the photoreceptor drum 21 surface, easily causing white voids.

As the core particle, publicly known magnetic particles can be used, but ferrite particles are preferable in view of static charge performance and durability. As the ferrite particle, publicly known products can be used. For example, zinc ferrite, nickel ferrite, copper ferrite, nickel zinc ferrite, manganese magnesium ferrite, copper magnesium ferrite, manganese zinc ferrite, manganese copper zinc ferrite and the like can be listed. These ferrite particles can be obtained by blending the raw materials, prebaking the mixture and pulverizing, then burning. It is possible to make the surface configuration of the particles different by changing the burning temperature. Here, prebaking can be done either in a batch-wise operation or in a continuous operation using a rotary kiln etc.

As the coating material, publicly known resin materials can be used. Silicone resin is particularly preferable. Coating the carrier surface with resin improves electric insulation and contributes to producing images free from fogging and coarseness. Further, since silicone resin is excellent in anti-pollution performance and abrasion resistance, use of silicone makes the carrier surface unlikely to be polluted hence contributes to producing images free from fogging and coarseness even when the carrier is used over a prolonged period of time.

As the silicone resin, publicly known products can be used. Examples include: silicone varnishes (products of GE Toshiba Silicones Co., Ltd.: TSR115, TSR114, TSR102, TSR103, YR3061, TSR110, TSR116, TSR117, TSR108, TSR109, TSR180, TSR181, TSR187, TSR144 and TSR165, or products of Shin-Etsu Chemical Co., Ltd.: KR271, KR272, KR275, KR280, KR282, KR267, KR269, KR211 and KR212); alkyd-modified silicone varnishes (products of GE Toshiba Silicones Co., Ltd.: TSR184 and TSR185); epoxy-modified silicone varnishes (products of GE Toshiba Silicones Co., Ltd.: TSR194 and YS54); a polyester-modified silicone varnish (products of GE Toshiba Silicones Co., Ltd.: TSR187); acryl-modified silicone varnishes (products of GE Toshiba Silicones Co., Ltd.: TSR170 and TSR171), urethane-modified silicone varnish (manufactured by GE Toshiba Silicones Co., Ltd.: TSR175); and reactive silicone resins (products of Shin-Etsu Chemical Co., Ltd.: KA1008, KBE1003, KBC1003, KBM303, KBM403, KBM503, KBM602 and KBM603).

In order to control the resistivity of the carrier, a resistance regulator is preferably added to the coating material. Examples of the resistance regulator include silicon oxide, alumina, carbon black, graphite, zinc oxide, titanium black, iron oxide, titanium oxide, tin oxide, potassium titanate, calcium titanate, aluminum borate, magnesium oxide, barium sulfate, calcium carbonate and others.

Coating the carrier particles with a coating material can be done by publicly known methods. Examples includes: an immersing process of immersing carrier particles into an organic solvent solution of a coating material; a spraying process of spraying an organic solvent solution of a coating material to carrier particles; a fluidized bed process of spraying an organic solvent solution of a coating material with the carrier particles floated by fluidized air; and a kneader-coater process of mixing carrier particles and an organic solvent solution of a coating material in a kneader-coater and removing the solvent. In the above processes, the organic solvent solution of the coating material can contain the aforementioned resistance regulator together with the coating material.

As the electrostatic latent image is developed, a toner image is formed on the photoreceptor drum 21 surface. The toner image is primarily transferred to intermediate transfer belt 7 at the first transfer position.

Photoreceptor drum cleaner 25 includes a cleaning blade 31, a cleaner housing 32 and a seal 33.

Cleaning blade 31 is placed in pressure contact, abutting the photoreceptor drum 21 surface in a counter direction against the rotational direction C thereof so as to scrape residues from the photoreceptor drum 21 surface. Cleaner housing 32 is used to collect the scraped residues. Cleaning blade 31 is attached to cleaner housing 32. Seal 33 is used to seal off the interior of the cleaning housing 32, and is arranged upstream of cleaning blade 31 with respect to the rotational direction C of photoreceptor drum 21 with its one end fixed to cleaner housing 32 and the other end put in contact with photoreceptor drum 21.

As shown in FIG. 3, developing unit 24 includes developing hopper 26 for storing dual-component developer 34 (which will be also referred to hereinbelow as "developer"). In developing hopper 26, an opening month is formed at the position opposing the outer peripheral surface of photoreceptor drum 21.

Inside developing hopper 26, developing roller 27 that supports the developer on the outer peripheral surface thereof and conveys and supplies the developer to photoreceptor drum 21 to develop the electrostatic latent image is provided at a position opposing the opening mouth. Developing roller 27 is arranged a clearance apart from the outer peripheral surface of photoreceptor drum 21.

Developing roller 27 includes a multi-pole magnetic member 35 having multiple magnetic poles and a non-magnetic sleeve 36 which is rotatably fitted on multi-pole magnetic member 35. Multi-pole magnetic member 35 has a plurality of magnetic poles 41 to 45 formed of bar magnets having rectangular sections, radially arranged circumferentially apart from each other.

Of these magnetic poles, that opposing the developing nip portion is named a main magnetic pole 41. There are two magnetic poles adjacent to main magnetic pole 41; the one which is located upstream with respect to the developing roller 27's conveying direction D of the developer is named an adjacent magnetic pole 42 and the other which is located downstream with respect to the developing roller 27's conveying direction D of the developer is named an adjacent magnetic pole 43. Of the other magnetic poles, the one that is located next to adjacent magnetic pole 42 is named a magnetic pole 44 and the one that is located next to adjacent magnetic pole 43 is named a magnetic pole 45.

Main magnetic pole 41, magnetic pole 44 and magnetic pole 45 have the same polarity while adjacent magnetic pole 42 and adjacent magnetic pole 43 have the dissimilar polarity to that of main magnetic pole 41. In the present embodiment, main magnetic pole 41 and magnetic poles 44 and 45 are N-poles and adjacent magnetic poles 42 and 43 are S-poles.

The dual-component developer 34 drawn up by magnetic pole 44 is regulated in layer thickness under the influence of adjacent magnetic pole 42, and formed into a magnetic brush at the developing nip portion by main magnetic pole 41 so that the toner is supplied to photoreceptor drum 21. Dual-component developer 34 after development is returned into developing hopper 26 under the influence of adjacent magnetic pole 43 and released by the effect of magnetic pole 45.

Multi-pole magnetic member 35 is unrotatably supported by both side walls of developing hopper 26 such that main magnetic pole 41 (N-pole having a peak value of 110 mT) is oriented, for example 8 degrees away to the downstream side with respect to the conveyed direction D of the developer, from the direction toward the rotational center of photoreceptor drum 21; adjacent magnetic pole 42 (S-pole having a peak value of −78 mT, about 71% of main magnetic pole 41) is oriented, for example 59 degrees away to the upstream side with respect to the conveyed direction D of the developer, from main magnetic pole 41; magnetic pole 44 (N-pole having a peak value of 56 mT) is oriented, for example 117 degrees away to the upstream side with respect to the conveyed direction D of the developer, from main magnetic pole 41; magnetic pole 45 (N-pole having a peak value of 42 mT) is oriented, for example 224 degrees away to the upstream side with respect to the conveyed direction D of the developer, from main magnetic pole 41; and adjacent magnetic pole 43 (S-pole having a peak value of −80 mT, about 73% of main magnetic pole 41) is oriented, for example 282 degrees away to the upstream side with respect to the conveyed direction D of the developer, from main magnetic pole 41.

Regulating member 28 for limiting the thickness of the developer layer carried on the outer peripheral surface of developing roller 27 so as to control the amount of the developer to be conveyed to the electrostatic latent image, is disposed at a position near the opening mouth of developing hopper 26 and on the upstream side with respect to the conveyed direction of the developer by developing roller 27. This regulating member 28 is arranged a predetermined distance away from the outer peripheral surface of developing roller 27.

Further, agitating member 29 for agitating the developer in developing hopper 26 and supplies the developer to developing roller 27 is rotatably arranged inside developing hopper 26 at a position opposing developing roller 27.

Photoreceptor drum 21 incorporates an opposing magnetic pole 46 formed of a bar magnet having a rectangular section, at a position opposing main magnetic pole 41 across the photosensitive layer. Opposing magnetic pole 46 has the polarity (S-pole in the present embodiment) opposite main magnetic pole 41.

Opposing magnetic pole is N-pole. Opposing magnetic pole 46 (N-pole having a peak value of 35 mT, about 32% of main magnetic pole 41) is unrotatably supported relative to a rotary axis 21*a* of photoreceptor drum, being oriented, for example 7 degrees away to the upstream side with respect to the conveyed direction D of the developer, from the direction toward the rotational center of photoreceptor drum 21. For example, the magnetic pole is supported by a support member 47.

Figure 6:
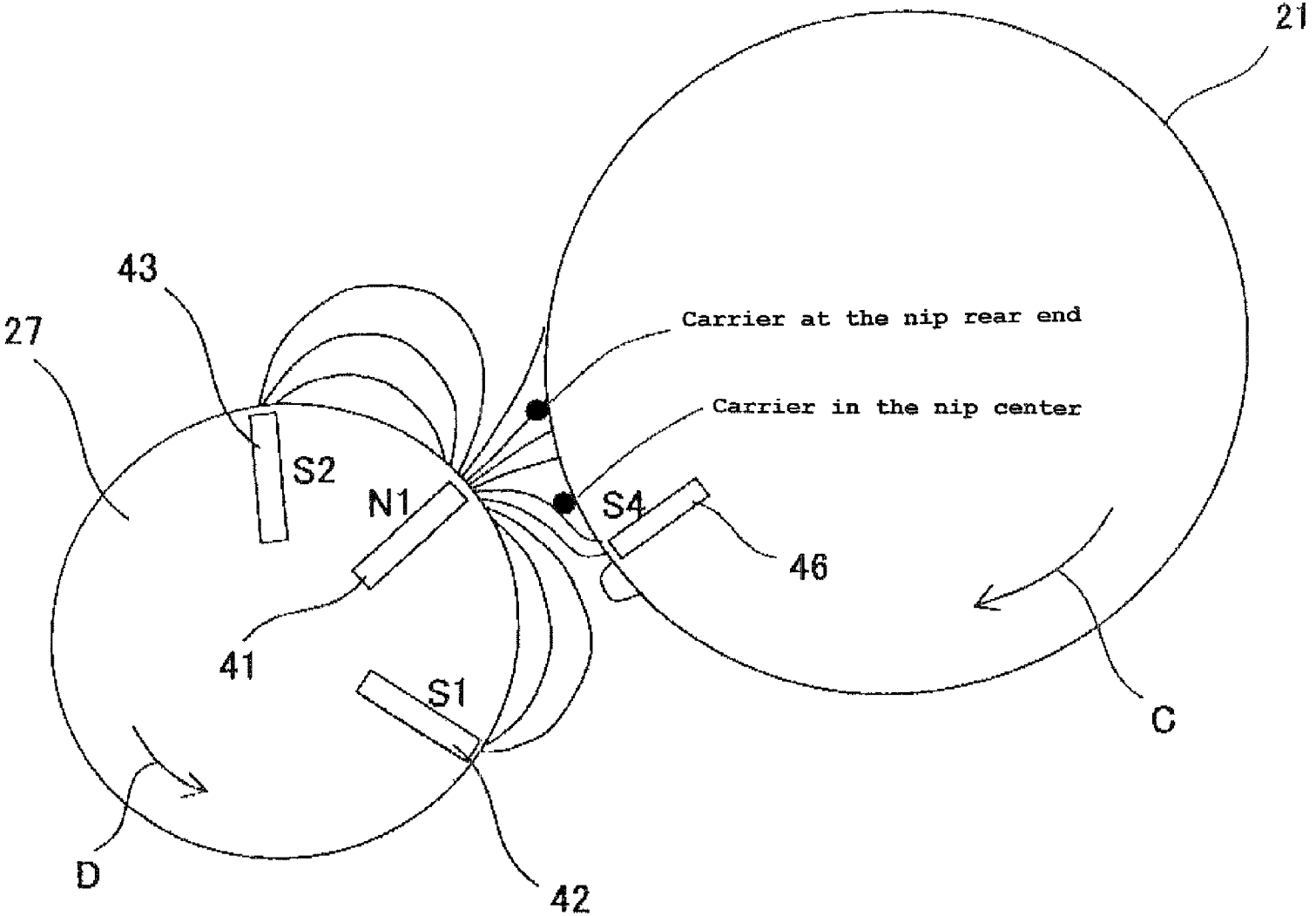

FIG. 6 is a schematic view showing how lines of magnetic force are formed around the developing nip. Main magnetic pole 41 is disposed away to the downstream side with respect to the rotational direction D of the developing roller from the closest position where the distance between developing roller 27 and photoreceptor drum 21 is shortest (the position on the line from the rotary axis of the developing roller to the rotary axis of photoreceptor drum 21) while opposing magnetic pole 46 is disposed away to the upstream side with respect to the rotational direction of the developing roller from the closest position where the distance between developing roller 27 and photoreceptor drum 21 is shortest (the position on the line from the rotary axis of the photoreceptor drum to the rotary axis of developing roller 27). This arrangement produces lines of magnetic force from main magnetic pole 41 toward opposing magnetic pole 46, which widen the developing nip width, making it possible to produce high image density.

Since main magnetic pole 41 is arranged on the downstream side of the closest position between the developing roller and the photoreceptor drum, it is possible to form a soft magnetic brush around the closest position. As a result, it is possible to prevent the carrier in the center of the nip from disturbing the toner image on the photoreceptor drum, hence produce an image that is high in dot reproduction performance. Further, since the force for attracting the carrier at the rear end of the nip on the downstream side of the developing nip can be enhanced, it is possible to prevent the carrier from being developed, hence produce images free from white voids.

The magnetic flux density of the magnetic field formed by main magnetic pole 41 on the center surface of the main magnetic pole preferably falls within the range of 100 mT to 140 mT. In the present embodiment, the magnetic flux density is 110 mT. With this specification, even if a fine particulate carrier is used, it is possible to prevent the carrier from being developed on photoreceptor drum 21 without causing any disturbance of the toner image on the photoreceptor drum.

If the magnetic flux density is less than 100 mT, the carrier together with the toner will adhere to photoreceptor drum 21, causing degradation of the image due to the carrier in the printed image. If the magnetic flux density is in excess of 140 mT, the rubbing force of the magnetic brush becomes too strong in the center of the developing nip despite that the effect of suppressing adhesion of the carrier to photoreceptor drum 21 is little enhanced, hence the toner image on the photoreceptor drum 21 surface is disturbed by the strong rubbing force, causing deterioration of image quality of the resultant image.

The magnetic flux density of the magnetic field formed by opposing magnetic pole 46 on the center surface of the opposing magnetic pole preferably falls within the range of 15% to 35% of the magnetic flux density of the magnetic field on the center surface of the main magnetic pole. In the present embodiment, it is about 32%.

This specification prevents carrier development on photoreceptor drum 21, hence making it possible to produce images free from white voids. Further, this also imparts appropriate rubbing force to the magnetic brush, it is hence possible to produce high-quality images while suppressing disturbance of toner images.

If less than 15% the effect of widening the developing nip width cannot be obtained sufficiently, it is hence difficult to obtain high image density. When in excess of 35%, the formation of the magnetic brush becomes unstable and the rubbing force lowers, so that it is impossible to obtain high image density.

Main magnetic pole 41 is preferably positioned such that the angle, designated at θ1, formed between the straight line joined between the center of main magnetic pole 41 and rotary axis 27*a* of developing roller 27 and the straight line joined between rotary axis 27*a* of developing roller 27 and rotary axis 21*a* of photoreceptor drum 21, falls within the range of 3 degrees to 10 degrees. If it is less than 3 degrees, the effect of suppressing carrier development lowers, whereas if it exceeds 10 degrees, the rubbing force of the magnetic brush in the developing nip lowers, making it difficult to obtain high image density.

Opposing magnetic pole 46 is preferably positioned such that the angle, designated at θ2, formed between the straight line joined between the center of the opposing magnetic pole and rotary axis 21*a* of the photoreceptor drum and the straight line joined between rotary axis 27*a* of developing roller 27 and rotary axis 21*a* of photoreceptor drum 21, falls within the range of 2 degrees to 10 degrees. If it is less than 2 degrees, the effect of widening the nip width lowers, making it difficult to obtain high image density. On the other hand, if it exceeds 10 degrees, the rubbing force of the magnetic brush in the developing nip lowers, making it difficult to obtain high image density.

The carrier used for the dual-component developer is preferably specified such that its saturation magnetization falls within the range of 30 emu/g to 70 emu/g. If it is less than 30 emu/g, carrier development becomes prone to occur. On the other hand, when it exceeds 70 emu/g, the rubbing force of the magnetic brush becomes too strong, hence the dot reproducibility lowers.

The volume mean diameter of the carrier preferably falls within the range of 20 μm to 60 μm. When it is less than 20 μm, carrier development is prone to occur. When it exceeds 60 μm, the performance of imparting charge to the toner lowers, hence fogging and toner scattering occur and the dot reproducibility also lowers particularly when fine particulate toner is used.

The carrier surface is preferably coated with silicone resin. Since silicone resin is excellent in anti-pollution performance and abrasion resistance, use of silicone makes the carrier surface unlikely to be polluted hence contributes to producing images free from fogging and coarseness even when it is used over a prolonged period of time.

EXAMPLE

Now, the technology will be described in a specific manner by taking an example and a comparative example. However, the present invention should not be particularly limited as long as the technology does not deviate from the essence of the technology. Hereinbelow, "parts" and "%" indicate "parts by weight" and "% by weight" unless otherwise specified.

[Toner Preparation]

<Black Toner>

Bisphenol A propylene oxide, terephthalic acid and trimellitic anhydride were used as monomers and polycondensed to obtain polyester resin as a binder resin.

100 parts by weight of the polyester resin (glass transition temperature: 62 deg. C, softening temperature: 120 deg. C)

5 parts by weight of a coloring agent (carbon black, trade name: MA-77, manufactured by MITSUBISHI CHEMICAL CORPORATION)

2 parts by weight of a charge control agent (boron compound, trade name: LR-147, manufactured by HODOGAYA Chemical Co., Ltd.)

3 parts by weight of a releasing agent (paraffin wax, trade name: HNP-9, manufactured by NIPPON SEIRO CO. LTD.)

The above toner materials were mixed for 10 minutes by a Henschel mixer, then the mixture was fused, kneaded and dispersed by a kneading and dispersing processor (KNEADEX MOS140-800: manufactured by MITSUI MINING CO., LTD). The kneaded product was crushed by a cutting mill. Then, the crush was pulverized by a jet-type pulverizer (trade name: IDS-2 type, manufactured by Nippon Pneumatic Mfg. Co., Ltd.), and classified using an air classifier (trade name: MP-250 type, manufactured by Nippon Pneumatic Mfg. Co., Ltd.) to prepare a coloring resin particulate having a volume mean diameter of 5.5 μm.

Here, the volume mean diameter was measured by Coulter Multisizer II (trade name, manufactured by Beckman Coulter, Inc.).

Two parts by weight of hydrophobic particulate silica (with a BET specific area of 140 $m^2/g$) having a mean primary diameter of about 12 nm, which has been surface treated with hexamethyldisilazane, was added to 100 parts of the obtained coloring resin particles, and the mixture was mixed by a Henschel mixer for two minutes to prepare a negatively chargeable black toner.

<Cyan Toner>

A cyan toner was prepared in the same manner as the black toner except in that a coloring agent (trade name: C.I. pigment blue 15:3, manufactured by MITSUBISHI CHEMICAL CORPORATION) was used.

<Magenta Toner>

A magenta toner was prepared in the same manner as the black toner except in that a coloring agent (trade name: C.I. pigment red 122, manufactured by MITSUBISHI CHEMICAL CORPORATION) was used.

<Yellow Toner>

A yellow toner was prepared in the same manner as the black toner except in that coloring agent (trade name: C.I. pigment yellow 74, manufactured by MITSUBISHI CHEMICAL CORPORATION) was used.

[Carrier]

As the ferrite particles to be the core particles, ferrite powder was measured and mixed by a ball mill, then prebaked by a rotary kiln at 900 deg. C. The resultant prebaked ferrite powder was pulverized by a wet-type pulverizer using steel balls as a pulverizing medium into particles having a mean diameter of 2 μm or below. The obtained ferrite particulate was granulated into particles having diameters of 100 to 200 μm by spray drying and the resultant granulated particles were baked at 1300 deg. C. Then, the resultant product was crushed by a crusher to obtain ferrite particles having a volume mean diameter of about 25 μm.

Next, for a coating liquid for covering the core particles, a silicone resin (trade name: TSR115, manufactured by GE Toshiba Silicones Co., Ltd.) was dissolved into toluene to prepare a coating liquid.

This coating liquid was used to coat the above ferrite particles by a dip coater, and the resultant was heated under reduced pressure to remove toluene, whereby a carrier coated with silicone resin in a coated amount of 5% was prepared. The coated amount of silicone resin was determined by measuring the Fe content derived from ferrite particles and the Si content derived from silicone resin using an X-ray fluorescence analyzer and making calculation based on these measurements.

[Dual-Component Developer]

The dual-component developers were prepared by blending and agitating 5 parts of each toner thus produced in the above manner and 95 parts of the carrier using a Nauta mixer (trade name: VL-0, manufactured by Hosokawa Micron Corporation) for 20 minutes. Thus, dual-component developers including each toner (black, cyan, magenta and yellow) were prepared.

[Photoreceptor Drum]

The coating liquid for an undercoat layer was prepared by adding 7 parts of titanium oxide (trade name: TTO55A, manufactured by Ishihara Industry Co., Ltd.) and 13 parts of copolymerized nylon (trade name: CM8000, manufactured by TORAY INDUSTRIES, INC.) to a mixture solvent of 159 parts of methyl alcohol and 106 parts of 1,3-dioxolane and dispersing the mixture for 8 hours using a paint shaker. This coating liquid was supplied to a coating vessel, and a cylindrical conductive substrate made of aluminum was immersed, and then drawn up and dried naturally to form an undercoat layer of 1 μm thick.

Next, the coating liquid for a charge generation layer was prepared by adding 3 parts of titanyl phthalocyanine and 2 parts of butyral resin (trade name: BL-1, manufactured by SEKISUI CHEMICAL CO., LTD.) to 245 parts of methylethylketone and dispersing the mixture using a paint shaker. This coating liquid was applied over the aforementioned undercoat layer surface in a dip coating process similar to the case of the undercoat layer, and naturally dried without wiping the lower end to form a charge generation layer of 0.4 μm thick.

Next, the coating liquid for a charge transport layer was prepared by adding 5 parts of a charge transportive compound (trade name: T405, manufactured by Takasago Chemical Corp.), 2.4 parts of polycarbonate (trade name: G400, manufactured by Idemitsu Kosan Co., Ltd.), 1.6 parts of polycarbonate (trade name: GH503, manufactured by Idemitsu Kosan Co., Ltd.), 2.4 parts of polycarbonate (trade name: TS2020, manufactured by TEIJIN CHEMICALS LTD.) and 0.25 part of 2,6-bis-tert-butyl-4-methylphenol (trade name: Sumilizer BHT, manufactured by Sumitomo Chemical Co., Ltd.) into 49 parts of tetrahydrofran and dissolved therein. This coating liquid was supplied to a coating vessel so as to be applied by a dip coating process over the charge generation layer surface. Then the product was dried for one hour at 130 deg. C. to form a charge transport layer. Thus, an electrophotographic photoreceptor having a film thickness of 25 μm was completed. The film thickness of photoreceptor drum 21 was measured using a spectrophotometer (trade name: MCPD-1100, manufactured by OTSUKA ELECTRONICS CO., LTD.).

A photoreceptor drum 21*k* of 60 mm in diameter with a developing roller 27*k* of 40 mm in diameter was used for toner image forming device 2*k*. Photoreceptor drums 21*c*, 21*m* and 21*y* of 30 mm in diameter were used with developing rollers 27*c*, 27*m* and 27*y* of 20 mm in diameter for toner image forming devices 2*c*, 2*m* and 2*y*, respectively.

[Developing Roller]

The developing rollers 27 in the above-described image forming apparatus 1 were used.

[Paper]

As the test paper for the present embodiment, A4-sized recycled paper (trade name: Recycle Pure, SHARP DOCUMENT SYSTEMS CORPORATION) was used.

[Image Evaluation]

The result of a continuous print test performed using image forming apparatus 1 will be described.

The processing speed of toner image forming devices 2 was set at 175 mm/sec while the peripheral speed of developing rollers 27 was set at 280 mm/sec. As the dual-component developer, photoreceptor drums 21 and the paper for the test, those described above were used.

Toner image forming devices 2 were adjusted so that the amount of toner adherence on the paper was 0.5 mg/cm$^2$, and a printing test of 1,000 sheets was performed. The photography in the obtained images and the fine line images were clear with high image density. No image defect such as white voids and imperfection was observed. No adherence of the carrier to the photoreceptor drums was observed.

COMPARATIVE EXAMPLE

Figure 1:
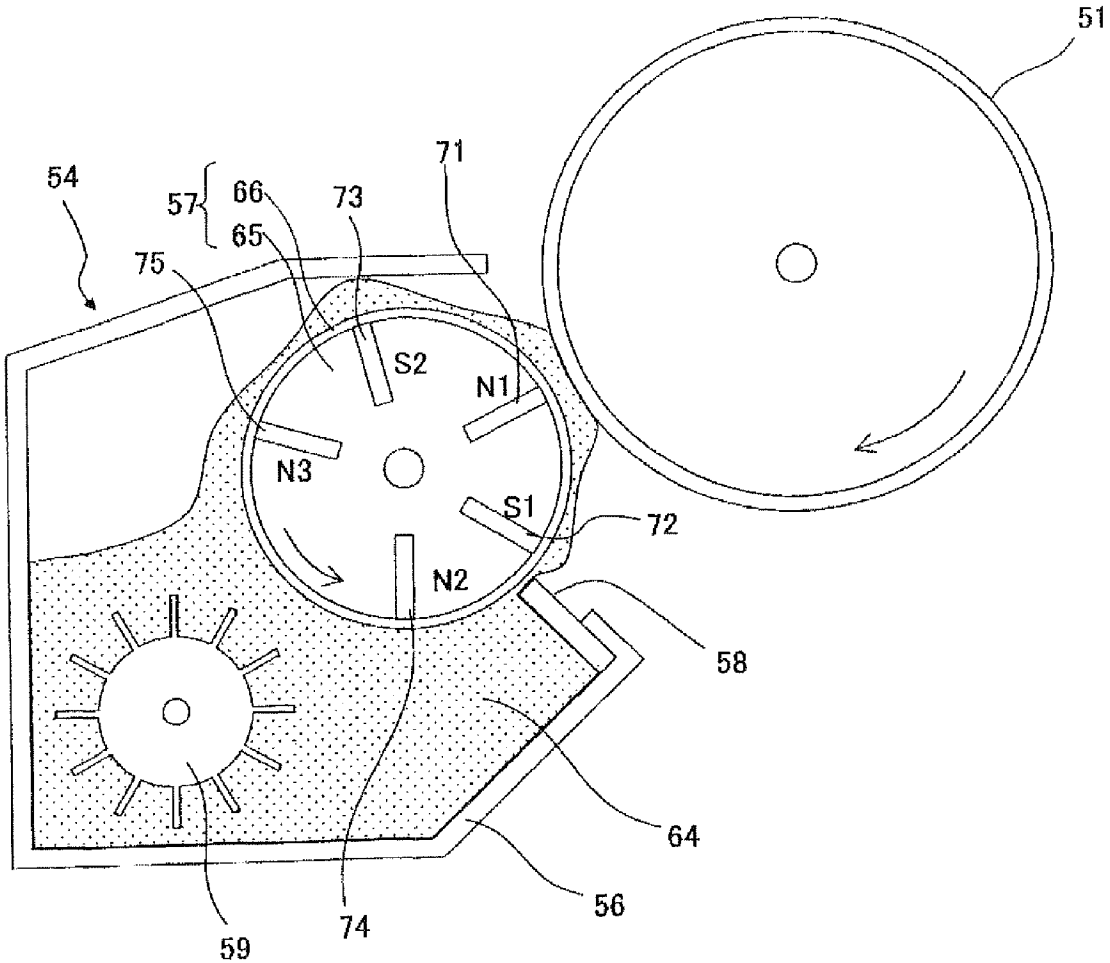
Prior Art FIG. 1
FIG. 1 is a schematic view showing the configuration of a conventional photoreceptor drum, developing unit and their surroundings.
Figure 2:
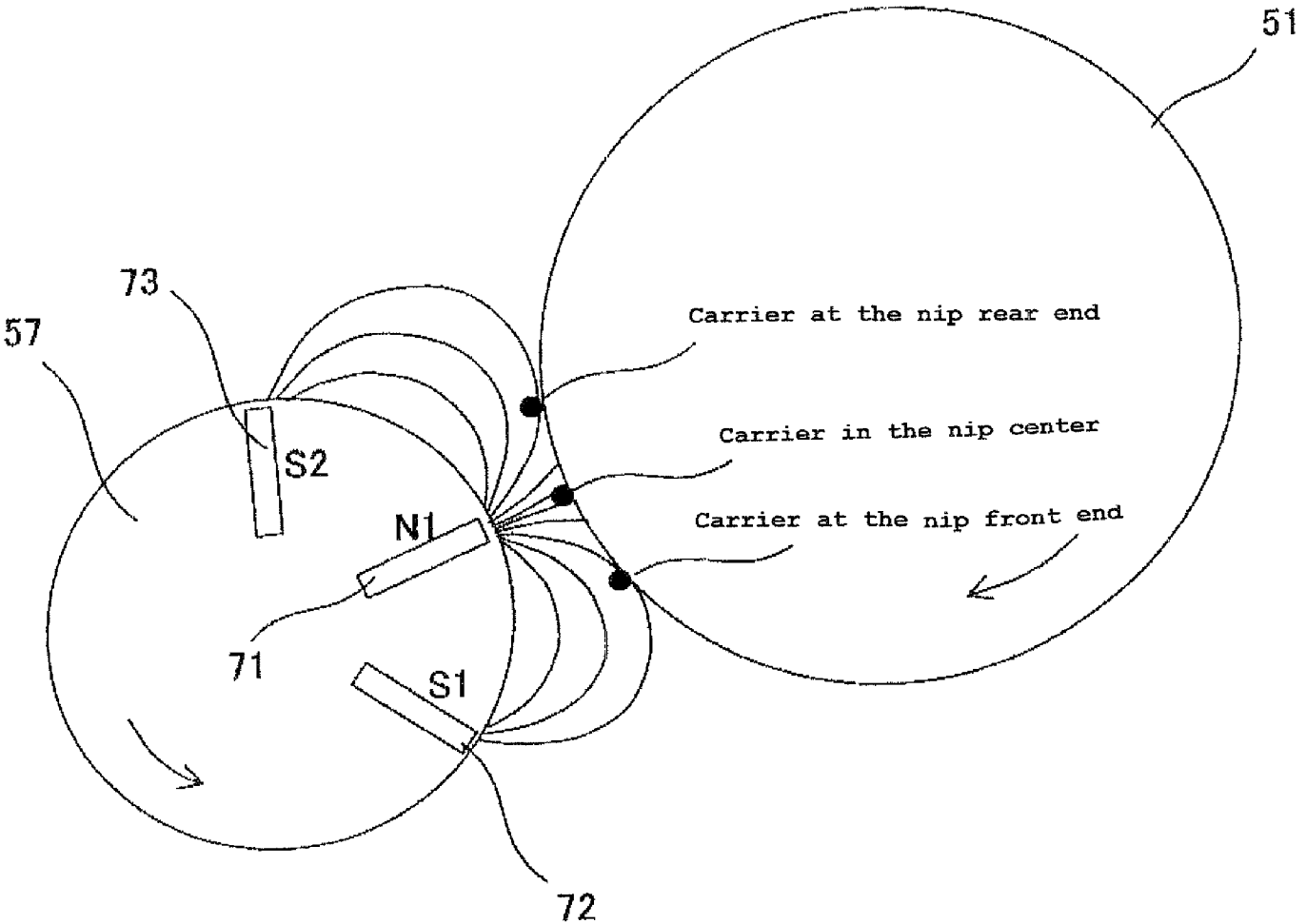
FIG.2 Prior Art
FIG. 2 is a schematic view showing lines of magnetic force in the surroundings of a conventional photoreceptor drum and developing unit.

Image forming was performed under the same condition as that for the example except in that the developing rollers having the magnet arrangement shown in FIG. 1 were used, and the images were evaluated. On the average, the obtained images had about 10 white voids for each sheet and adherence of the carrier to the photoreceptor drums was observed.

What is claimed is:

1. An image forming apparatus comprising:

a photoreceptor drum including a photosensitive layer; and, a developing roller for supplying a dual-component developer to the photoreceptor drum, characterized in that:

the developing roller includes a main magnetic pole for forming a magnetic brush that rubs and supplies the dual-component developer over the photoreceptor drum;

the photoreceptor drum includes an opposing magnetic pole having a polarity that is dissimilar from that of the main magnetic pole, located at a position opposing the main magnetic pole across the photosensitive layer;

the main magnetic pole is disposed away to the downstream side with respect to the rotational direction of the developing roller from the closest position where the distance between the developing roller and the photoreceptor drum is shortest while the opposing magnetic pole is disposed away to the upstream side with respect to the rotational direction of the developing roller from the closest position of the developing roller and the photoreceptor drum; and the magnetic flux density of the magnetic field formed by the opposing magnetic pole on the center surface of the opposing magnetic pole falls within the range of 15% to 35% of the magnetic flux density of the magnetic field formed by the main magnetic pole on the center surface of the main magnetic pole.

2. The image forming apparatus according to claim 1, wherein the magnetic flux density of the magnetic field formed by the main magnetic pole on the center surface of the main magnetic pole falls within the range of 100 mT to 140 mT.

3. The image forming apparatus according to claim 1, wherein the angle formed between the straight line joined between the center of the main magnetic pole and the rotary axis of the developing roller and the straight line joined between the rotary axis of the developing roller and the rotary axis of the photoreceptor drum falls within the range of 3 degrees to 10 degrees.

4. The image forming apparatus according to claim 1, wherein the angle formed between the straight line joined between the center of the opposing magnetic pole and the rotary axis of the photoreceptor drum and the straight line joined between the rotary axis of the developing roller and the rotary axis of the photoreceptor drum falls within the range of 2 degrees to 10 degrees.

5. The image forming apparatus according to claim 1, wherein the dual-component developer includes a carrier having a saturation magnetization falling within the range of 30 emu/g to 70 emu/g.

6. The image forming apparatus according to claim 5, wherein the volume mean diameter of the carrier falls within the range of 20 μm to 60 μm.

7. The image forming apparatus according to claim 5, wherein the surface of the carrier is coated with silicone resin.

8. An image forming apparatus comprising:

a photoreceptor drum including a photosensitive layer; and, a developing roller for supplying a dual-component developer to the photoreceptor drum, characterized in that:

the developing roller includes a main magnetic pole for forming a magnetic brush that rubs and supplies the dual-component developer over the photoreceptor drum;

the photoreceptor drum includes an opposing magnetic pole having a polarity that is dissimilar from that of the main magnetic pole, located at a position opposing the main magnetic pole across the photosensitive layer;

the main magnetic pole is disposed away to the downstream side with respect to the rotational direction of the developing roller from the closest position where the distance between the developing roller and the photoreceptor drum is shortest while the opposing magnetic pole is disposed away to the upstream side with respect to the rotational direction of the developing roller from the closest position of the developing roller and the photoreceptor drum; and the angle formed between the straight line joined between the center of the main magnetic pole and the rotary axis of the developing roller and the straight line joined between the rotary axis of the developing roller and the rotary axis of the photoreceptor drum falls within the range of 3 degrees to 10 degrees.

9. An image forming apparatus comprising:

a photoreceptor drum including a photosensitive layer; and, a developing roller for supplying a dual-component developer to the photoreceptor drum, characterized in that:

the developing roller includes a main magnetic pole for forming a magnetic brush that rubs and supplies the dual-component developer over the photoreceptor drum;

the photoreceptor drum includes an opposing magnetic pole having a polarity that is dissimilar from that of the main magnetic pole, located at a position opposing the main magnetic pole across the photosensitive layer;

the main magnetic pole is disposed away to the downstream side with respect to the rotational direction of the developing roller from the closest position where the distance between the developing roller and the photoreceptor drum is shortest while the opposing magnetic pole is disposed away to the upstream side with respect to the rotational direction of the developing roller from the closest position of the developing roller and the photoreceptor drum; and the angle formed between the straight line joined between the center of the opposing magnetic pole and the rotary axis of the photoreceptor drum and the straight line joined between the rotary axis of the developing roller and the rotary axis of the photoreceptor drum falls within the range of 2 degrees to 10 degrees.

* * * * *